United States Patent [19]

Gramera

[11] Patent Number: 4,743,025

[45] Date of Patent: May 10, 1988

[54] VISUALLY DIFFERENTIATING THE CODED COMBINATIONS OF THREE DIES

[76] Inventor: Robert E. Gramera, 1027 Raleigh St., Denver, Colo. 80204

[21] Appl. No.: 678,117

[22] Filed: Dec. 4, 1984

[51] Int. Cl.[4] ..... A63F 9/04

[52] U.S. Cl. ..... 273/146

[58] Field of Search ..... 273/146, 138, 268, 274, 273/142 E

[56] References Cited

U.S. PATENT DOCUMENTS

| | | | |
|---|---|---|---|
| 1,223,365 | 4/1917 | Breitung | 273/146 |
| 1,537,605 | 5/1925 | Hansen | 273/94 |
| 1,577,932 | 3/1926 | Palese | 273/94 |
| 3,896,574 | 7/1975 | McNaney | 273/146 X |
| 4,158,921 | 6/1979 | Stolpen | 273/146 |
| 4,314,698 | 2/1982 | Dolah | 273/146 |
| 4,357,015 | 11/1982 | Santora et al. | 273/142 E |
| 4,431,189 | 2/1984 | Wiencek et al. | 273/138 A |
| 4,467,424 | 8/1984 | Hedges et al. | 273/138 A X |
| 4,517,558 | 5/1985 | Davids | 273/138 A UX |

FOREIGN PATENT DOCUMENTS

| | | | |
|---|---|---|---|
| 588254 | 5/1977 | Switzerland | 273/146 |

OTHER PUBLICATIONS

Ex parte Gwinn, 112 U.S.P.Q 441.

*Primary Examiner*—Paul E. Shapiro

[57] ABSTRACT

Each of the two hundred sixteen possible numerical combinations of three six-sided dice is visually differentiated, one from the other, by retaining the six differently numbered faces on a conventional first neutral die; coding each of the six differently numbered faces on a second die with separate figure symbols; and coding each of the six numbered faces on a third die with separate colors and five different numbers. One of the faces of the third die repeats the number on one of the other faces of that die. Rolling the set of three dice over an extended period of time will display each of the expected fifteen numerical sums, ranging in values from three through seventeen, in two-hundred-sixteen separate and visually differentiated combinations, each turning up with equal odds of 1 in 216. Development of this coding technique, to separate and expand the normally expected fifteen numerical sums to two-hundred-sixteen numerical scores, by visually differentiating each of two-hundred-sixteen possible combinations of three six-sided dice, rolled with equal odds, affords a simplified but practical application to create a variety of new dice related games incorporating game boards, playing cards or a combination thereof.

2 Claims, 3 Drawing Sheets

VISUALLY DIFFERENTIATING THE CODED COMBINATIONS OF THREE DIES

FIELD OF INVENTION

This invention describes the development of a coding technique, wherein the visually differentiated rolled combinations of three multi-sided dice, that turn up with identifiable odds, can be applied as a means to create a variety of new dice games.

BACKGROUND OF THE INVENTION

Each face of a conventional six-sided die displays one of six numbers ranging in values from 1 through 6, traditionally represented by funneled dots. Since there are six ways each of three six-sided dice can turn up in a dice roll; 6 (die one)×6 (die two)×6 (die three); two-hundred-sixteen possible combinations of three dice will display each of the normally expected sixteen numerical sums, ranging in values from three through eighteen.

The renowned Italian Scientist, Galilei Galileo (1564–1642), notably recognized as an astronomer, philosopher, physicist and mathematician, is credited for having established the odds or probabilities that occur when three dice are simultaneously rolled out over an extended period of time, as illustrated in Table I.

combinations for the numerical sums of four, five, six, seven, eight, nine, twelve, thirteen, fourteen, sixteen or seventeen, as shown in Table I.

Since the three dice in a set of conventional dice are of identical color, it is virtually impossible for game participants to visually differentiate each of the two-hundred-sixteen possible rolled combinations that display the sixteen numerical sums, ranging in values from three through eighteen. Without the ability to visually differentiate each of the two-hundred-sixteen possible numerical combinations of three dice, all current dice related games using a conventional set of 3 dice of one color, incorporating various game boards, playing cards or a combination thereof, are limited to only the normally expected sixteen visually discernable numerical scores, each of which turns up with varying odds. As a result, a great number of games currently available, utilize either several six-sided dice or dice with more than six sides, to compensate for the scoring limitation that is clearly evident when either a set of two or three conventional six-sided dies are used in various games of chance.

Color or symbol coding each of the six or more numbered or unnumbered faces on a die or multiples of such dice, as a means to develop specific dice related games, incorporating game boards, playing cards or a combination thereof, is widely exemplified in the patent literature, with specific references cited in U.S. Pat. Nos. 1,481,628; 1,631,505; 2,526,300; 2,922,652; 3,055,662; 3,433,483; 3,709,498, 3,977,679; 4,015,850; 4,046,381; 4,261,574; 4,335,879; 4,346,900 and 4,436,306. However, no where in the patents cited or for that matter in the general patent literature, has it been found or is it apparent to one skilled in the art, that any of the coding techniques employed for the specific games described, can be directly applied or could have been developed to visually differentiate each and every possible numerical combination of three equally numbered dice, rolled out with equal odds, as a simplified and practical means to create a family of new dice related games that may incorporate game boards, playing cards or any combination of such paraphernalia.

TABLE I

| Number On 3rd Dice | Number Of Ways Each Possible Sum May Be Obtained With 3 Dice — Sum Of 3 Dice | | | | | | | | | | | | | | | |
|---|---|---|---|---|---|---|---|---|---|---|---|---|---|---|---|---|
| | 3 | 4 | 5 | 6 | 7 | 8 | 9 | 10 | 11 | 12 | 13 | 14 | 15 | 16 | 17 | 18 |
| 1 | 1 | 2 | 3 | 4 | 5 | 6 | 5 | 4 | 3 | 2 | 1 | | | | | |
| 2 | | 1 | 2 | 3 | 4 | 5 | 6 | 5 | 4 | 3 | 2 | 1 | | | | |
| 3 | | | 1 | 2 | 3 | 4 | 5 | 6 | 5 | 4 | 3 | 2 | 1 | | | |
| 4 | | | | 1 | 2 | 3 | 4 | 5 | 6 | 5 | 4 | 3 | 2 | 1 | | |
| 5 | | | | | 1 | 2 | 3 | 4 | 5 | 6 | 5 | 4 | 3 | 2 | 1 | |
| 6 | | | | | | 1 | 2 | 3 | 4 | 5 | 6 | 5 | 4 | 3 | 2 | 1 |
| Total Number of Ways | 1+ | 3+ | 6+ | 10+ | 15+ | 21+ | 25+ | 27+ | 27+ | 25+ | 21+ | 15+ | 10+ | 6+ | 3+ | 1 = 216 combinations |

Examination of the rolled combinations, shows that the normally expected sixteen sums of 3 dice, ranging in values from three through eighteen, turn up for a total of exactly two-hundred-sixteen ways, with each of the sixteen sums rolled out with varying odds as follows: Sums three and eighteen, with odds of 1 in 216; sums four and seventeen, with odds of 1 in 72; sums five and sixteen, with odds of 1 in 36; sums six and fifteen, with odds of 5 in 108; sums seven and fourteen, with odds of 5 in 72; sums eight and thirteen, with odds of 7 in 72; sums nine and twelve, with odds of 25 in 216; and sums ten and eleven, with odds of 1 in 8.

Although Galileo established the odds or probabilities when three six-sided dice are rolled out over an extended period of time, only sixteen numerical sums, out of two-hundred-sixteen rolled combinations, can be visually differentiated with a set of three conventional dice of one color. For example, even though the sums of either ten or eleven can be rolled out in twenty-seven different ways, as illustrated in Table I, with a conventional set of three dice of one color, only one sum of either ten or eleven can be visually differentiated in any kind of game of chance. In other words, even though there are twenty-seven separate ways the sums of either ten or eleven can turn up in a dice roll, there are no games currently available that can be played with a set of three six-sided dice of one color, to visually differentiate the twenty-seven possible ways to obtain the sums of either ten or eleven, or for that matter, any of the

SUMMARY OF THE INVENTION

With a set of three six-sided dice, each of the two-hundred-sixteen possible numerical combinations is visually differentiated, one from the other, by retaining the six numbered faces on the first neutral die in, for example, either black or white; figure symbol coding each of the six numbered faces on the second die; and by color coding each of the six numbered faces on the third die. Development of this dice coding technique provides a means whereby the normally expected fifteen numerical sums, ranging in values from three through seventeen, can be further separated and expanded into two-hundred-sixteen visually discernable numerical scores, each rolled out with equal odds of 1 in 216. This coding technique, applied to a set of three dice, affords the opportunity to create a wide variety of new and entertaining dice games that may incorporate game boards, playing cards or a combination thereof; four games of which are herein described and designed with the objective to further reduce the instant invention to practice, which in essence, exemplifies the novelty of the invention. The major advantage of the instant invention lies in the fact that a coded set of three dice increases the range of scoring in games, from fifteen visually discernable ways, to two-hundred-sixteen, each of which turns up with equal odds of 1 in 216.

BRIEF DESCRIPTION OF THE DRAWINGS

The invention will be more readily understood by referring to the accompanying drawn figures, which are intended as illustrative of the invention, rather than as limiting the invention to the specific details herein set forth.

DETAILED DESCRIPTION OF THE INVENTION

Figure 1:
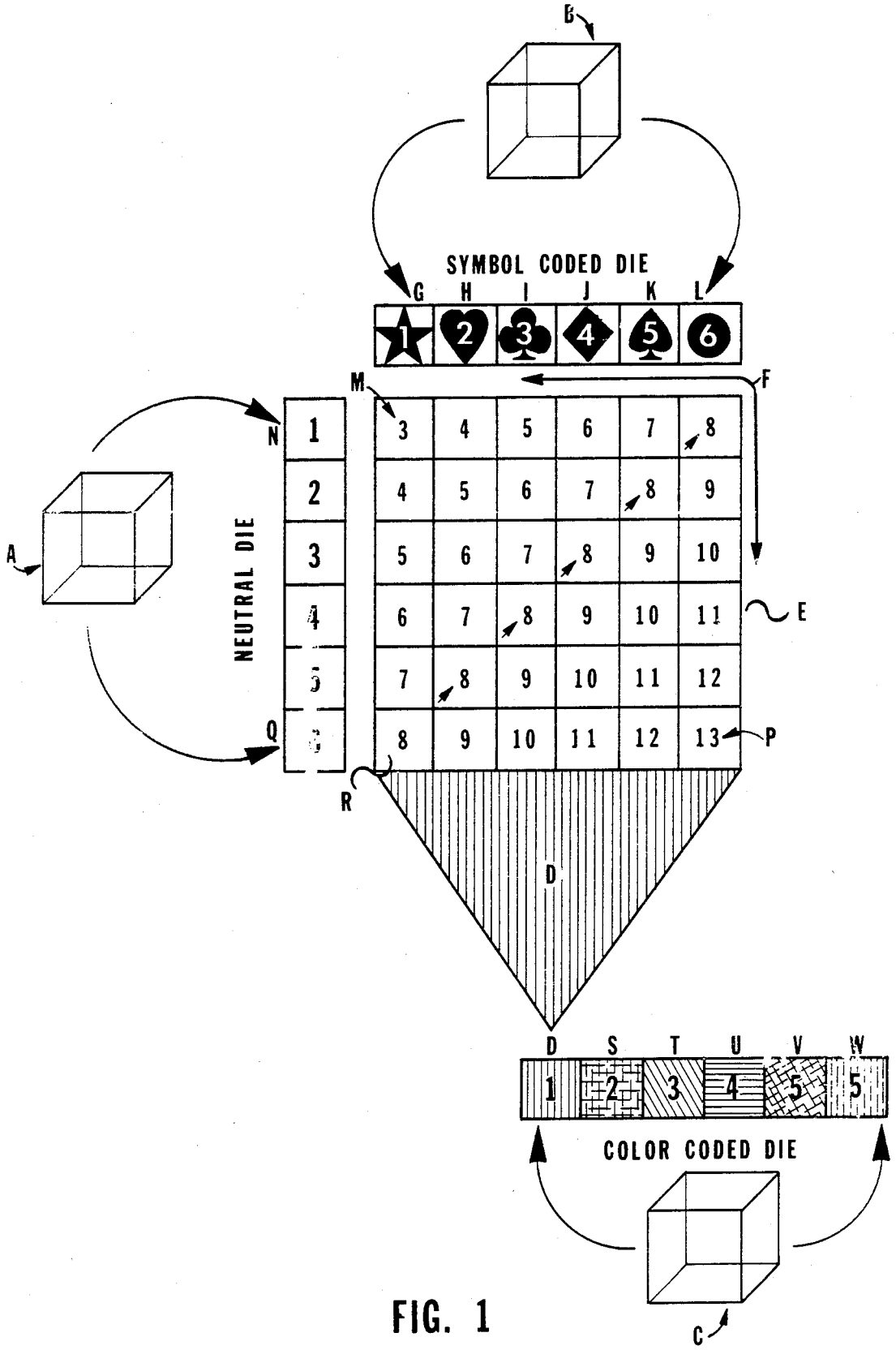
FIG. 1, is a diagrammatic sketch that illustrates how thirty-six visually differentiated numerical combinations, out of a first possible two-hundred-sixteen, are obtained when a neutral numbered die and a second figure symbol coded numbered die are rolled out together with the single face of a third color coded numbered die.

To render the instant invention readily understandable, FIG. 1 is provided to illustrate how the first, for example, black or white numbered die A, hereinafter referred to as the "neutral" die and the second figure symbol coded numbered die B, are rolled out together with one of six numbered faces of the third color coded die C, from within the, for example, red color coded series D, to reveal one of the six sets of color coded grids E, also shown in FIG. 2, containing thirty-six visually differentiated numerical combinations F, of the six color coded figure symbols of, for example, a Star G, Heart H, Club I, Diamond J, Spade K and Moon L. The color coded series D, also shown in FIG. 2, and, for example, the red face D of die C, having a numerical value of one, are equally identified by the letter D in FIG. 1, because successive rolls of dice A and B with the red face D of die C, establishes the color coded series D of the thirty-six numerical combinations F in grid E for the red color coded figure symbols G, H, I, J, K and L.

For example, the sum of three red Stars M, in grid E, is established by adding the numerical value one, that appears on face N of die A, to the numerical value one, that appears on face G of die B, to the numerical value one, that appears on face D of die C. In another example, the sum of thirteen red Moons P, in grid E, is established by adding the numerical value six, that appears on face Q of die A, to the numerical value six, that appears on face L of die B, to the numerical value one, that appears on face D of die C.

Having established how, for example, three red Stars M and, for example, thirteen red Moons P are obtained in grid E, with numerical combinations F, the balance of the thirty-four numerical combinations of dice A, B and C can be determined in, for example, the red color coded series D, of numbered figure symbols G, H, I, J, K and L.

It stands to reason that if all three dice A, B and C were not coded, but simply numbered, each of the six possible sums of eight R, shown in grid E, of FIG. 1, could not be visually differentiated, one from the other.

Figure 2:
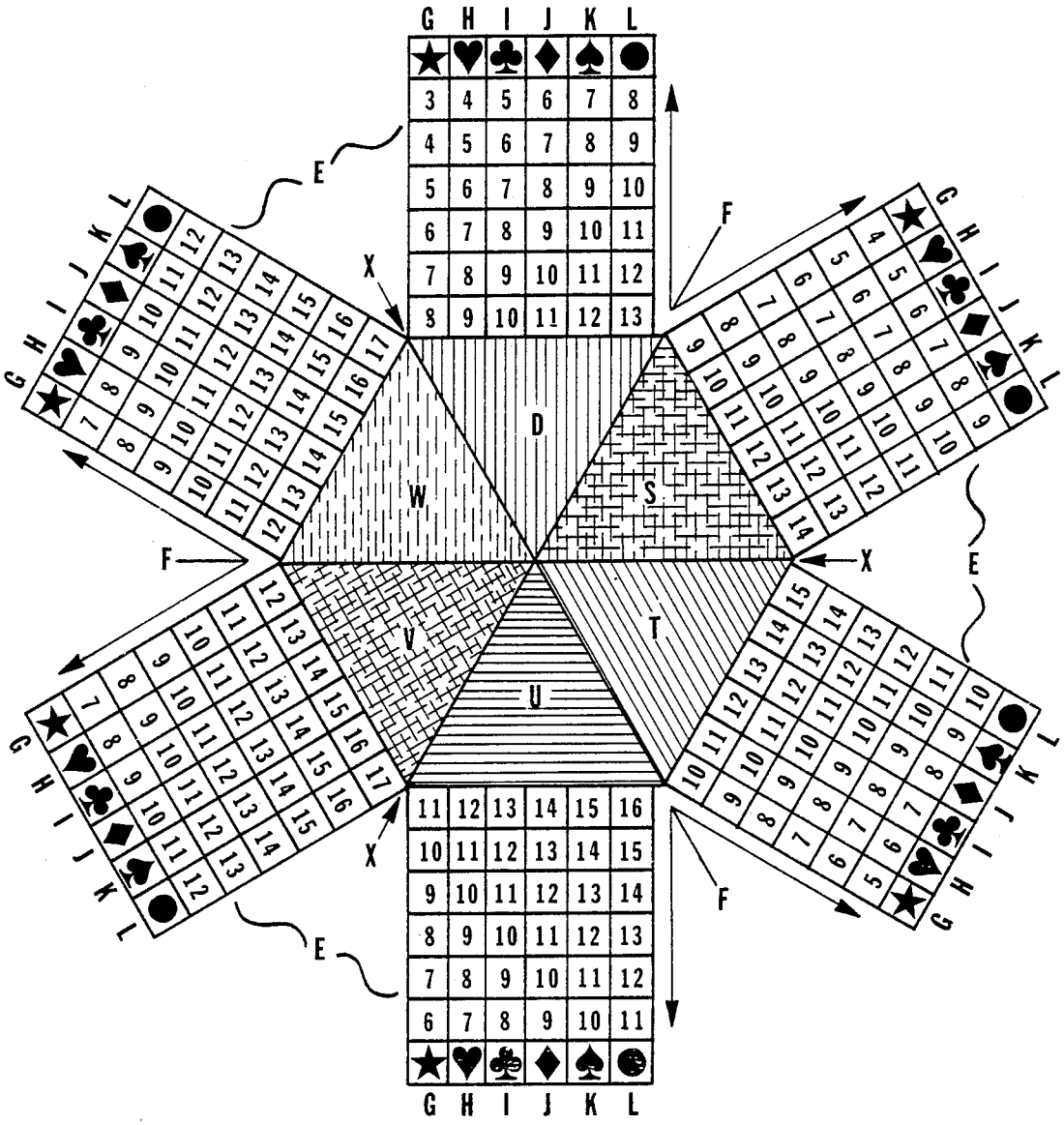
FIG. 2, representative of the instant invention, is a diagrammatic sketch illustrating two-hundred-sixteen possible combinations of three dice, each visually differentiated, one from the other.

Having described in detail how the thirty-six numerical combinations F, in FIG. 1, are developed in, for example, the red color coded series D, of coded figure symbols G, H, I, J, K and L, the balance of five grids E, shown in FIG. 2, each containing thirty-six numerical combinations F, for a total of two-hundred-sixteen combinations, can be determined and visually differentiated, by combining dice A and B, with for example, the yellow face S; the, for example, green face T; the, for example, blue face U; the, for example, orange face V; and the, for example, purple face W of color coded die C.

FIG. 2, representative of the instant invention, contains six color coded triangles X, each of which match and project one of the six faces D, S, T, U, V and W of the color coded die C, shown in FIG. 1, making it possible to visually differentiate the six color coded sets of numbered figure symbols G, H, I, J, K and L that appear on the six faces of die B, illustrated in FIG. 1 and FIG. 2. Combining dice A and B with each face D, S, T, U, V and W of die C, shown in FIG. 1, makes it possible to establish each of two-hundred-sixteen numerical combinations F, each visually differentiated, one from the other, shown in FIG. 2 of the instant invention, following the rationale previously discussed for establishing the color coded series D in FIG. 1. To be more specific, each of the six grids E, containing thirty-six numerical combinations F, of figure symbols G, H, I, J, K and L, is identified by the color that appears in the respective adjacent triangles X, each having a color identical to one of six faces D, S, T, U, V and W of color coded die C, described in FIG. 1.

Whereas each of the sixteen visually differentiated sums, ranging in values from three through eighteen, is rolled out in varying odds with a set of three conventionally numbered six-sided one color dice, as shown in Table 1, each of the two-hundred-sixteen visually differentiated numerical combinations F, illustrated in FIG. 2, is rolled out with equal odds of 1 in 216, with a set of dice A, B and C. For example, Table 1 shows that there are several possible rolled combinations of the sums of either ten or eleven. However, Table 1 does not visually differentiate the individual combinations within the two groups of several sums of either ten or seven. FIG. 2, on the other hand, of the instant invention, shows how each of the several rolled combinations of either ten or eleven is visually differentiated, one from the other, by simply counting the differentiated combinations of symbol figures in each of the six color coded grids E, shown in FIG. 2. Although Galileo may have established the odds or probabilities in rolling three dice over an extended period of time, only the instant invention, illustrated in FIG. 2, furnishes the means to visually identify each probability. In other words, whereas Table 1 shows how two-hundred-sixteen combinations of three dice are distinguishable in groups for the numerical sums of three through eighteen, FIG. 2 visually differentiates each of the two-hundred-sixteen combinations, one from the other in sums of three through seventeen.

For example, Table 1 shows that the sum of six can be rolled out in 10 different ways. However, each of the 10 different sums of six cannot be individually identified; only one six is visually perceived with the three conventionally numbered six-sided dice of one color. Examination of FIG. 2 shows 4 sixes in, for example, the red series D, 3 sixes in, for example, the yellow series S, 2 sixes in, for example, the green series T and 1 six in, for example, the blue series U, for a total of 10 individually differentiated sixes, each identified by the different coded figure symbols G, H, I, and J in the four color coded grids E of color coded series D, S, T and U.

Each group of combinations referred to as, Total Number of Ways, shown in Table 1 for the fifteen sums of three through seventeen, can be separated and visually identified in FIG. 2, following the rationale previously discussed to identify the 10 combinations for the sum of six.

Having developed the coding technique to visually differentiate each of the two-hundred-sixteen possible combinations of three six-sided dice, it is now possible to simplify the face design on either die B or die C. For example, it is not necessary to number any of the six faces on the second figure symbol coded die B, so long as six separate figure symbols appear on each face of the die. It is also not necessary to number any of the six faces on the third color coded die C, again, so long as six separate colors appear on each face of the die. In other words, eliminating the numerals on dice B or C die, will still result in two-hundred-sixteen combinations F, of die A, B and C, each visually differentiated, one from the other, again so long as the six numerals from 1 to 6 are retained on the first neutral die A in the dice set. This point is further amplified in the following example: If only two dice in the set of three dice are numbered, the thirty-six combinations F, in the red coded series D, of FIG. 1, would be distributed between two through twelve, rather than between three M through thirteen P. In fact, this identical distribution of thirty-six numbers would also show up in the yellow S, green T, blue U, orange V and purple W color coded grids E, shown in FIG. 2. Identical sets of thirty-six numbers showing up in each of the six grids E, would not nullify a visual differentiation of the two-hundred-sixteen combinations of three dice, since each of the six figure symbols G, H, I, J, K or L differentiate the numerical combinations in each of the six color coded grids E. In another example, if only one of the three dice is numbered in the set of dice, the thirty-six combinations F, in all six grids E, would be distributed between one through six, following the rationale previously discussed for the numbering of two dice.

Eliminating the need to number one or two of the dice, yet maintaining the ability to visually differentiate the two-hundred-sixteen possible combinations of three disc rolled with equal odds, provides the means to create a wide variety of entertaining games that are very easy to understand, when played in combination with either game boards or playing cards.

Developing a coding technique to visually identify and differentiate each and every combination of three dice, makes it also possible to design the dies to either decrease or increase the number of visually differentiated rolled combinations. Table II exemplifies how the two-hundred-sixteen possible combinations of dice A, B and C can be reduced to one-hundred-eight, down to seventy-two, by simply decreasing the number of colors on the third color coded die C.

TABLE II

| Six-Sided Neutral Die A (Numerals) | | Six-Sided Symbol Coded Die B (Symbols) | | Six-Sided Color Coded Die C (Colors) | | Visually Differentiated Combinations |
|---|---|---|---|---|---|---|
| 6 | × | 6 | × | 6 | = | 216 |
| 6 | × | 6 | × | 3 | = | 108 |
| 6 | × | 6 | × | 2 | = | 72 |

In this case, the color coded die C is not numbered. However, the reduction of colors on the faces of die C must be done in such a manner that the remaining colors are equally distributed. In other words, if die C has three separate colors, the opposite sides of the six-sided die must have identical colors. If die C contains only two separate colors, three sides of the six-sided die would display one color, while the other three sides would display another color. Examination of the data in Table II clearly shows how the rolled combinations of an altered third color coded die C, will turn up in less than two-hundred-sixteen visually differentiated ways, each with equal odds.

Table III, exemplifies how the number of rolled combinations can be increased, by simply increasing the numbered faces on the first neutral numbered die A.

TABLE III

| Multi-Sided Neutral Die A (Numerals) | | Six-Sided Symbol Coded Die B (Symbols) | | Six-Sided Color Coded Die C (Colors) | | Visually Differentiated Combinations |
|---|---|---|---|---|---|---|
| 8 | × | 6 | × | 6 | = | 288 |
| 12 | × | 6 | × | 6 | = | 432 |
| 30 | × | 6 | × | 6 | = | 1080 |
| 30 plus | × | 6 | × | 6 | = | 1080 plus |

In this case, the six faces of either the second figure symbol coded die B or the six faces of the third color coded die C do not have to be numbered. When dice B and C are combined with die A, having more than six numbered sides, considerably more than two-hundred-sixteen visually differentiated numerical combinations of these dice will result, as shown in Table III, with each combination rolled out with equal odds.

In the instant invention, it should be understood that the separate figure symbols that appear on die B or the separate colors that appear on die C can be substituted with other kinds of markings for the purpose of coding, provided however, each rolled combination of dice A, B and C can be visually differentiated, one from the other, to establish a numerical score in various games of chance. It is further understood that the number of sides of either die A, B or C can be greater or less than six, provided however, each rolled combination of dice A, B and C can be visually differentiated, one from the other, and the rolled odds are identifiable.

When two neutral six-sided dice A, are rolled out together with either a six-sided figure symbol coded die B or a six-sided color coded die C, only sixty-six combinations of the three dice can be visually differentiated, simply because with the two neutral dice A, only the normally expected eleven sums, ranging in values from two through twelve, can be visually identified. However, when these two neutral A are rolled out together with either a figure symbol coded die B or a color coded die C, sixty-six visually discernable numerical combinations are obtained, based on the formula: (Neutral die A)+(neutral die A)=eleven numerical sums. Eleven numerical sums×(die B) or ×(die C)=sixty-six visually differentiated figure symbol coded or color coded combinations, respectively, each rolled out with varying but identifiable odds. A combination of three six-sided dice, wherein two of the numbered dice are neutral and the third die is either figure symbol coded or color coded, resulting in only sixty-six visually differentiated combinations rolled with varying odds, is termed a "GLITCH", which provides the means to create several interesting games of chance. In this example, dice A, B or C may be designed with more or less than six sides, provided however, each rolled combination of dice A, B and B or A, A and C can be visually differentiated, one from the other, and the rolled odds are identifiable.

The instant invention is reduced to practice in part, but is not limited herein to four game examples that are described in detail. Without the means to visually differentiate the two-hundred-sixteen possible combinations F of dice A, B and C, with the coding technique developed in the instant invention, as illustrated in FIGS. 1 and 2, none of the following games could have been developed with the Roll-A-Way game board projected in FIG. 3.

Figure 3:
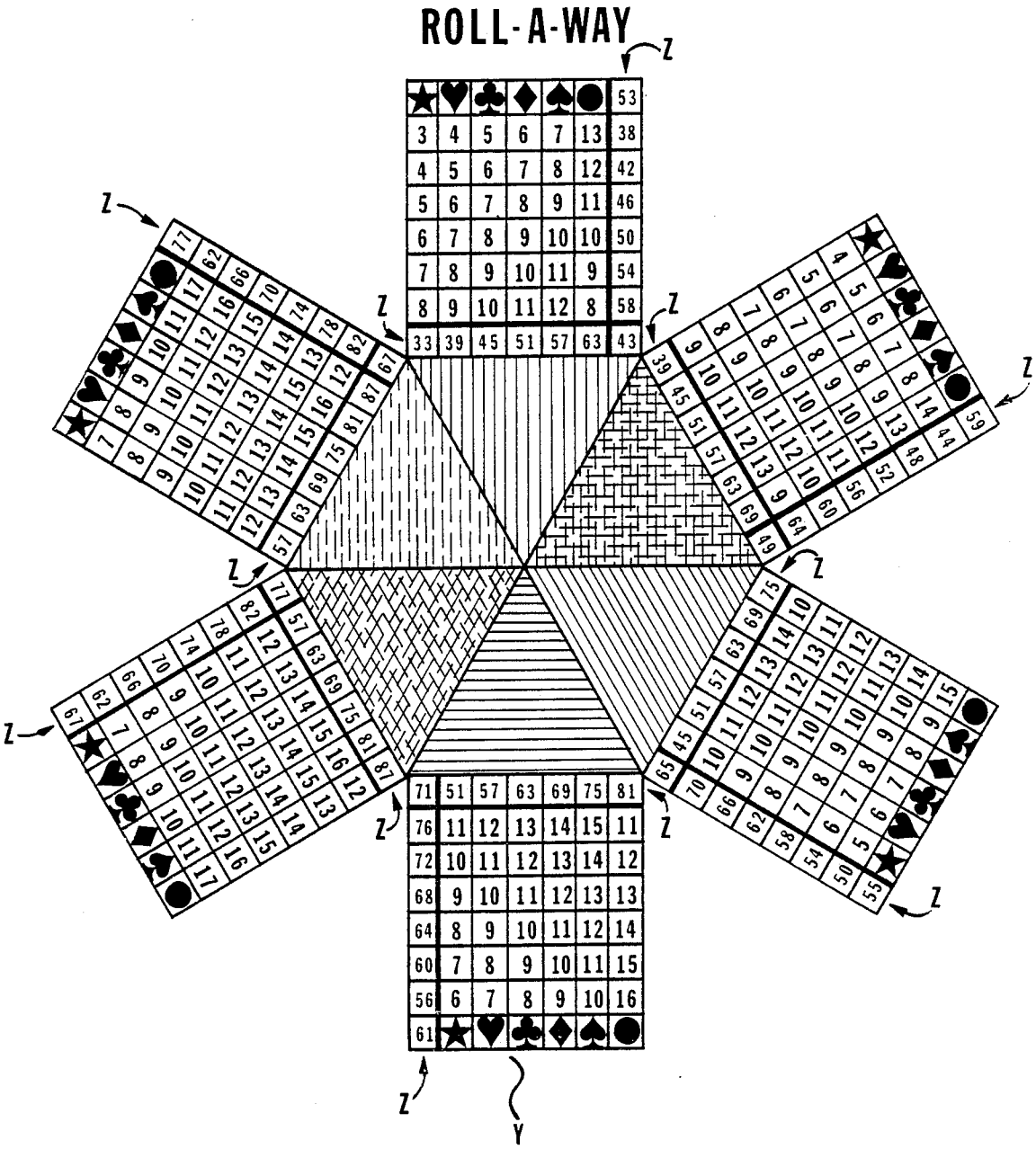
FIG. 3, is a diagrammatic sketch of the generically named Roll-A-Way Game Board used to illustrate four game examples of Rollette, Roll-Over, Dingo and Super Streak.

The game board Y, illustrated in FIG. 3 and identified by the generic name, Roll-A-Way, is designed to accommdate the means to play a variety of entertaining games. Similar in design to the instant invention shown in FIG. 2, the numbered combinations F in the vertical column of Moons L, in each of six color coded grids E, as shown in FIG. 2, is arranged in reverse order in each of the six vertical columns of Moons in the six color coded grids on game board Y of FIG. 3. This reverse order for the arrangement of the six numbered combinations in the vertical column of Moons in each of the six color coded grids, permits fourteen different composite scores that appear in columns Z of each color coded grid shown in FIG. 3. Each of the fourteen composite scores that appear in columns Z, is established by adding any six numerical combinations running either vertically, horizontally or diagonally in each of the six color coded grids. The fourteen composite scores within columns Z, in each of six color coded grids, permits a total of 84 participants to play the game of Super Streak, which is described in Game Example IV.

GAME EXAMPLE I

Rollette

No. of Players 2 to 18

The object of Rollette is to match one or more selected numbered combinations F, as shown in FIG. 2, from game board Y, illustrated in FIG. 3, with a preselected count of successive rolls of dice A, B and C.

Prior to commencement of the game, players may decide on an equal selection from one to a maximum of twelve color coded figure symbols G, H, I, J, K or L, as shown in FIG. 2, from within any one or all of the six sets of thirty-six numerical combinations F, that also appear on game board Y. Each player's selection of a numbered color coded figure symbol is then recorded on a scoring pad, which is signed and passed to the player designated to roll dice, A, B and C in the game. After each dice roll, a color coded numbered figure symbol on game board Y, matching a color coded numbered figure symbol that appears on the upper faces of cast dice A, B and C, is covered with, for example, a plastic chip or any other suitable marker. After the dice are rolled over a preselected number of times, the game ends, after which each player's numerical selection on his scoring pad is compared to one or more color coded symbols covered with the plastic chips on game board Y, which then determines the winner.

Depending on the rules adopted prior to commencement of the game, the winner is determined by the player who has either; (a) the highest numerical score obtained from a composite sum of all matched figure symbols, or (b) the greatest amount of numerical combinations on game board Y, matched by rolls of dies A, B and C.

GAME EXAMPLE II

Roll-Over

No. of Players 2 to 18

The object of Roll-Over is to match one or more color coded figure symbols that appear on cards in a player's hand, with a color coded figure symbol G, H, I, J, K or L, as shown in FIG. 2, that also appears on game board Y, illustrated in FIG. 3. In this game, two-hundred-sixteen playing cards are used, each of which is imprinted with a number that corresponds to each color coded figure symbol G, H, I, J, K or L, as shown in FIG. 2 and that also appears on game board Y, for a total of thirty-six color coded symbols in six numbered sets.

Players may select a dealer or establish one by the highest number rolled out with dice A, B and C. The game is played with either one or up to a maximum of twelve playing cards, depending on the dealer's selection, with cards thoroughly shuffled and dealt face down, one at a time to each player, from the dealer's left. Each player takes a turn to roll dice A, B and C. After each dice roll, a color coded figure symbol on game board Y, corresponding to the numerical sum of a color coded figure symbol that appears in a roll of dice A, B and C, is covered with, for example, a plastic chip or any other suitable marker. If a player holds a card(s) that matches the dice roll, he must lay it out face up. If a player rolls a coded sum already covered with a plastic chip, he must pass dice A, B and C to the player on his left. The first player who rolls over all of his card(s), wins the game.

GAME EXAMPLE III

Dingo

No. of Players 2 to 6

The object of Dingo is to match any six numbers running either vertically, horizontally or diagonally in an assigned color coded grid E, as shown in FIG. 2, on game board Y, illustrated in FIG. 3, with successive rolls of dice A, B and C. Since there are six color coded grids on game board Y, a maximum of six players may participate in a game of Dingo.

Each of six color coded cards, matching the colors of grids E, on playing board Y are shuffled. Players may agree on who should deal one card of six to each player, or establish a dealer by the player who rolls the highest score with dice A, B and C. The player on the dealer's left starts the game sequence by rolling dice A, B and C. When a numerical sum turns up with a color coded figure symbol that matches one of the numbers in a color coded grid on playing board Y, the player lays, for example, a plastic cover chip or any other suitable marker on that number. If a player rolls a coded sum, already covered with a plastic chip, he must pass dice A, B and C to the player on his left. The game sequence continues from one player to the next, until one player matches a series of six numbers appearing in his color coded grid E, running either vertically, horizontally or diagonally on the playing board Y. The first player who completes a set of six coded numbers matching his color coded card, yells out Dingo, and wins the game.

GAME EXAMPLE IV

Super Streak

No. of Players 2 to 84

The object of SUPER STREAK is to match a composite score on a single playing card with one of fourteen composite scores that appear in the vertical and horizontal columns Z, from within any one of six color coded grids on game board Y of FIG. 3.

Examination of game board Y, shows how the sum of six numerical combinations; six running vertically, six running horizontally and two running diagonally; furnish fourteen composite scores that appear in the vertical and horizontal columns Z from within a color coded grid. With all six color coded grids, it is possible for 84 participants to play Super Streak on game board Y. Since each of the fourteen composite scores in columns Z from within each color coded grid has a different numerical value, there are no tie scores to settle in the game. In the event two players simultaneously complete a series of six numerical combinations in a cross-pattern within a color coded grid, the player with the higher numerical composite score appearing in columns Z, wins.

Eachof the eighty-four cards in the deck is imprinted with one of eighty-four color coded composite scores that appear in columns Z from within each of six color coded grids, each containing the six figure symbols that comprise game board Y. Players may agree on who should deal one card of eighty-four in the deck, or establish a dealer by the player who rolls out the highest score with the set of dice A, B and C. The dealer thoroughly shuffles the eighty-four cards and then deals one card, face down, to each player from his left. The player on the dealer's left starts the game sequence by rolling the set of dice A, B and C. When a number turns up with a color coded figure symbol that matches one of the color coded figure symbols on game board Y, the player covers that number with, for example, a plastic chip or any other suitable marker. If a player rolls a numerical combination already covered with a plastic chip, he must pass dice A, B and C to the player on his left.

The game sequence continues from one player to the next, until one player matches a series of six numbers running either vertically, horizontally or diagonally on game board Y, from within any one of six color coded grids. The player who holds the card with a composite sum of any six color coded numbers that match one of the eighty-four composite scores that appear in columns Z on game board Y, wins the game.

The diagrammatic sketch of game board Y used in Game Examples I through IV, as illustrated in FIG. 3, in combination with the set of coded dice A, B and C, can easily be adapted for use in any type of electronically automated system that may incorporate either video or computer components.

While the invention has been described with specific embodiments thereof, it will be understood that it is capable of further modification and variation, as apparent to those skilled in the art of coding dice and to those skilled in designing appropriate related game boards.

I claim:

1. A set of three (3) multi-sided dice, comprising a first die having thereon a plurality of flat faces of equal area, all of said faces provided with the same background indicia, each face additionally carrying means representing a numeral, all said represented numerals being different from each other, a second multi-sided die having thereon the same number of flat faces as said first die, each face of said second die carrying means representing a numeral, each face on said second die carrying background indicia different from that on each other face and different from said background indicia on said first die; and a third multi-sided die having thereon the same number of flat faces as said first and second die, each face of said third die carrying means representing a numeral, each face on said third die carrying background indicia different from that on each face of said one of said second or third dice, whereby every possible combination of throws may be visually distinguished even when the numerical total of throws is the same.

2. The set of three (3) multi-sided dice described in claim 1, combined with a numbered game board, upon which each visually differentiated numerical sum rolled out by the dice set is displayed, thus constituting an apparatus, whereby a variety of different dice games can be played.

* * * * *